US011156145B2

(12) United States Patent
Benson et al.

(10) Patent No.: US 11,156,145 B2
(45) Date of Patent: Oct. 26, 2021

(54) EMISSIONS MODULE WITH ADJUSTABLE SIZING

(71) Applicant: Caterpillar Inc., Peoria, IL (US)

(72) Inventors: Wesley Gene Benson, Peoria, IL (US); Andrew M. Denis, Normal, IL (US); Joshua Lynn Ratts, East Peoria, IL (US); Jack Albert Merchant, West Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/751,748

(22) Filed: Jan. 24, 2020

(65) Prior Publication Data

US 2021/0231043 A1 Jul. 29, 2021

(51) Int. Cl.
*F01N 3/28* (2006.01)
*F01N 13/10* (2010.01)

(52) U.S. Cl.
CPC ..... *F01N 3/2892* (2013.01); *F01N 3/2825* (2013.01); *F01N 13/10* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,021,639 | A * | 2/2000 | Abe | B01D 53/94 60/295 |
| 8,795,598 | B2 | 8/2014 | Lawrukovich | |
| 9,759,108 | B2 * | 9/2017 | Wikaryasz | F01N 3/2066 |
| 10,086,333 | B2 * | 10/2018 | Denton | B01F 5/0688 |
| 10,100,700 | B2 * | 10/2018 | Zhang | F01N 3/103 |
| 2011/0023471 | A1 * | 2/2011 | Werni | F01N 3/035 60/297 |
| 2016/0032810 | A1 * | 2/2016 | Denis | B01F 5/0616 60/324 |
| 2016/0326938 | A1 * | 11/2016 | Zhang | F01N 3/2066 |
| 2019/0277179 | A1 * | 9/2019 | Goebel | F01N 3/103 |

* cited by examiner

*Primary Examiner* — Binh Q Tran
(74) *Attorney, Agent, or Firm* — Hibshman Claim Construction PLLC

(57) ABSTRACT

An emission module for treating exhaust gas including a housing, a first catalyst substrate positioned within the housing and having an inlet end, the first catalyst substrate defining a plurality of flow passages extending longitudinally from the inlet end, and a first restrictor plate positioned at the inlet end of the first catalyst substrate to block exhaust flow through a first portion of the plurality of flow passages while allowing exhaust flow through the remainder of the plurality of flow passages.

20 Claims, 6 Drawing Sheets

EMISSIONS MODULE WITH ADJUSTABLE SIZING

TECHNICAL FIELD

This disclosure relates to an emissions module, and in particular, to an emissions module with adjustable working catalyst volume and backpressure.

BACKGROUND

Exhaust aftertreatment systems are used to remove undesirable emissions from the exhaust of fossil fuel powered systems (e.g. diesel engine, gas engines, gas turbines), which may be used to drive, for example, generators, commercial vehicles, machines, ships, and locomotives. Exhaust aftertreatment systems may include a variety of emissions treatment technology.

Some exhaust aftertreatment systems reduce the toxicity of exhaust emissions by providing an environment for a chemical reaction involving catalysts in which toxic combustion byproducts are converted to less-toxic gases. Examples of emissions treatment technology utilizing catalysts include diesel oxidation catalysts (DOCs) and selective catalytic reduction catalysts (SCRs). DOCs, for example, will typically have multiple catalyst "bricks." Some catalyst bricks include a substrate with a plurality of cells providing fluid paths therethrough and will have catalysts coated on the substrate to react with exhaust flowing through the fluid paths.

Exhaust aftertreatment systems may be installed as original equipment or may be retrofitted to a specific application. Retrofitting previous generation engines with a production emissions module may allow the engine to meet local, regional, and national emissions regulations. In order for an emissions module to be paired with an engine, the correct volume of catalyst needs to be defined to meet the necessary emission limits and the resulting back pressure added on the engine needs to be quantified and checked against the limit of the rating. Depending on the rating, a necessary catalyst volume and backpressure on the engine may not be able to be attained by simply using a production emissions module.

U.S. Pat. No. 8,795,598, to Lawrukovich, discloses an exhaust treatment device having a first catalyst brick with a first insulating support cover and a second catalyst brick with a second insulating support cover. The first catalyst brick is disposed within a first segment of a housing, and the second catalyst brick is disposed within a second segment of the housing. The first segment has an inner periphery that is not equal to an inner periphery of the second segment and the first and second catalyst bricks each have nonuniform dimensions with respect to one another. The first and second insulating support covers are independently dimensioned in proportion to the first and second catalyst bricks respectively.

SUMMARY

In accordance with one aspect of the present disclosure, an emission module for treating exhaust gas includes a housing, a first catalyst substrate positioned within the housing and having an inlet end, the first catalyst substrate defining a plurality of flow passages extending longitudinally from the inlet end, and a first restrictor plate positioned at the inlet end of the first catalyst substrate to block exhaust flow through a first portion of the plurality of flow passages while allowing exhaust flow through the remainder of the plurality of flow passages.

In accordance with another aspect of the present disclosure, an engine system, includes an internal combustion engine having one or more engine cylinders and an exhaust manifold for routing exhaust gas from the one or more engine cylinders, an exhaust line configured to receive exhaust gas from the exhaust manifold, and an emission module positioned in the exhaust line for treating exhaust gas. The emissions module includes a housing, a first catalyst substrate positioned within the housing and having an inlet end, the first catalyst substrate defining a plurality of flow passages extending longitudinally from the inlet end, and a first restrictor plate positioned at the inlet end of the first catalyst substrate to block exhaust flow through a first portion of the plurality of flow passages while allowing exhaust flow through the remainder of the plurality of flow passages.

In accordance with another aspect of the present disclosure, a method of adjusting the amount of back pressure and the working catalyst volume of an engine system includes providing an emission module positioned in an exhaust line of the engine system, the emissions module having a first catalyst substrate defining a plurality of flow passages and blocking the flow of exhaust through a first portion of the plurality of flow passages while allowing a flow of exhaust flow through the remainder of the plurality of flow passages.

BRIEF DESCRIPTION OF THE DRAWINGS

Further features and advantages will be evident from the following illustrative embodiment which will now be described, purely by way of example and without limitation to the scope of the claims, and with reference to the accompanying drawings, in which:

DETAILED DESCRIPTION

While the present disclosure describes certain embodiments of an emissions module with adjustable working catalyst volume and backpressure, the present disclosure is to be considered exemplary and is not intended to be limited to the disclosed embodiments. Also, certain elements or features of embodiments disclosed herein are not limited to a particular embodiment, but instead apply to all embodiments of the present disclosure.

Figure 1:
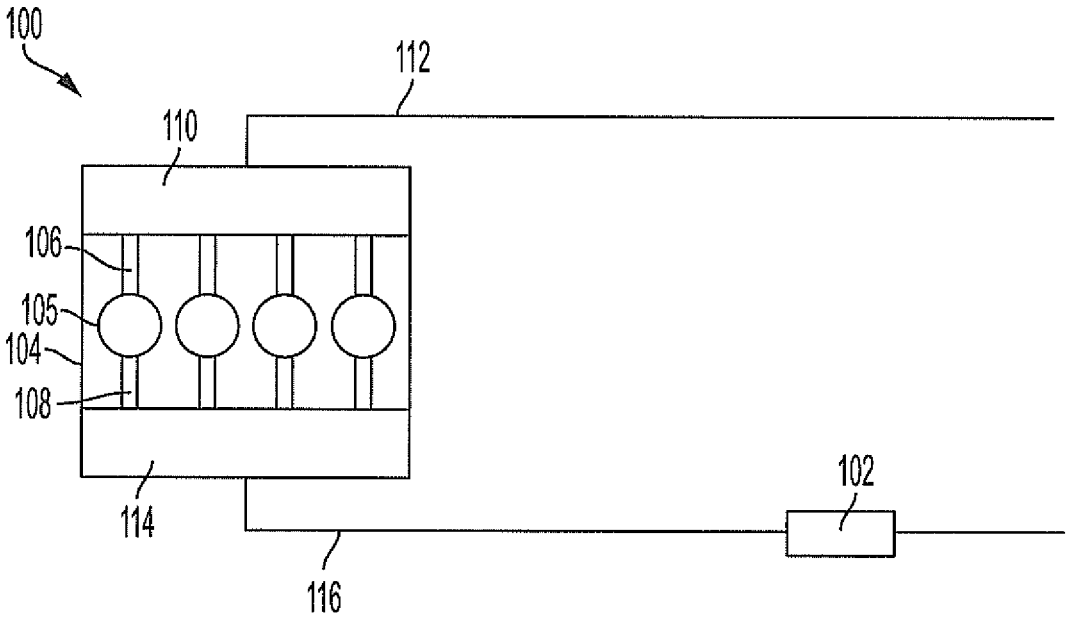
FIG. 1 is a schematic illustration of an exemplary engine system having an emission module.

Referring to the drawings, FIG. 1 is a schematic illustration of an exemplary engine system 100 having an emissions module 102. The engine system 100 includes an internal combustion engine 104, such as a diesel engine. The engine 104 may provide power to various types of applications and/or to machines. For example, the engine 104 may power a machine such as an off-highway truck, a railway locomotive, an earth-moving machine, such as a wheel loader, excavator, dump truck, backhoe, motor grader, material handler, or the like. The term "machine" can also refer to stationary equipment like a generator that is driven by an internal combustion engine to generate electricity.

The engine 104 includes one or more cylinders 105 implemented therein. In the illustrated embodiment, the engine 104 includes four cylinders 105. In other embodiments, however, the engine 104 may include more or less than four cylinders 105. The engine 104 may be of an in-line type, a V-type, a rotary type, or other types known in the art. Each of the cylinders 105 may be configured to slidably receive a piston (not shown) therein.

Each of the cylinders 105 includes one or more intake ports 106, each having an intake valve (not shown) and one or more exhaust ports 108, each having an exhaust valve (not shown). The intake valves and the exhaust valves are configured to regulate fluid communication into and out of the cylinders 105 via the one or more intake ports 106 and the one or more exhaust ports 108, respectively. The engine 104 includes an intake manifold 110 in fluid communication with an intake line 112 and an exhaust manifold 114 in fluid communication with an exhaust line 116. Intake air enters the one or more intake ports 106 from the intake line 112 via the intake manifold 110 and exhaust enters the exhaust line 116 from the one or more exhaust ports 108 via the exhaust manifold 114.

The emissions module 102 is disposed in the exhaust line 116 and may include a variety of emissions treatment technology. In the exemplary embodiment, the emissions module 102 is configured to convert an exhaust constituent from one composition to another composition. For example, the emissions module 102 may include one or more of a diesel oxidation catalyst (DOC), a selective catalytic reduction device (SCR), or some other catalytic converting device. In some embodiments, however, the emissions module 102 may also be configured to trap exhaust constituents, such as through the inclusion of a diesel particulate filter (DPF), and/or include any other exhaust aftertreatment device known in the art.

Figure 2:
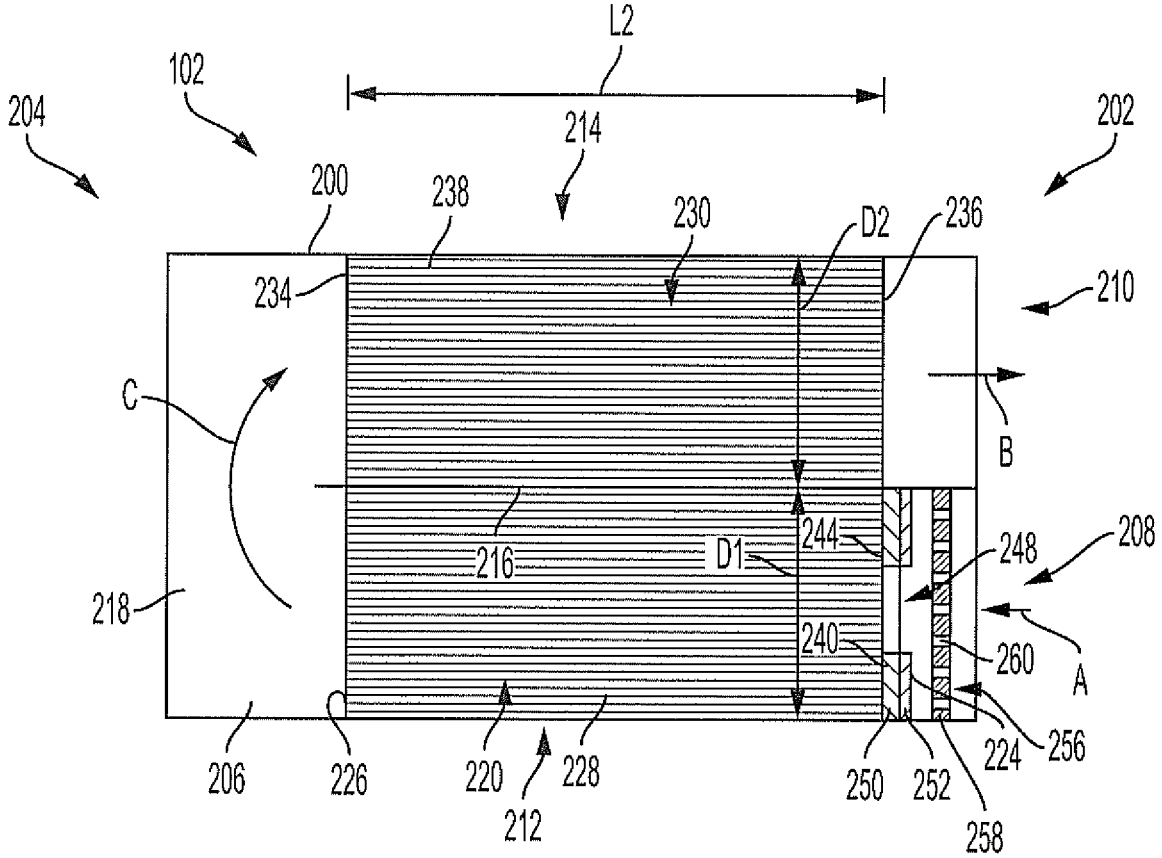
FIG. 2 is a schematic illustration of an exemplary embodiment of the emissions module of FIG. 1.

Referring to FIG. 2, an exemplary embodiment of the emissions module 102 includes a housing 200 having a first end 202 and a second end 204 opposite the first end 202. The housing 200 defines an exhaust flow path 206 including an exhaust inlet 208 and an exhaust outlet 210. In the illustrated embodiment, the exhaust flow path 206 is U-shaped including a first leg 212, a second leg 214 parallel to the first leg 212 and separated by a divider wall 216, and a transition portion 218 connecting the first leg 212 to the second leg 214. Exhaust flows through the first leg 212 in a first direction shown by the arrow A and flows through the second leg 214 in a second direction, opposite the first direction, shown by the arrow B. The transition portion 218 is configured to redirect the flow from the first leg 212 to the second leg 214 as shown by arrow C. Thus, the exhaust flows first through the first leg and then through the second leg in series. In other embodiments, however, the emissions module 102 may have an exhaust flow path other than U-shaped, such as for example, a linear, a serpentine, or some other shaped flow path.

In the illustrated embodiment, a first catalyst substrate 220 (i.e., a structure coated with, or otherwise acting as a carrier for, a catalyst), such as a DOC brick or SCR catalyst carrier, is positioned within the first leg 212 such that the exhaust flowing through the first leg 212 flows through the first catalyst substrate 220. The first catalyst substrate may be configured in a variety of ways, including, but not limited to, different shapes, sizes, and materials used. In the illustrated embodiment, the first catalyst substrate 220 includes a cylindrical first substrate 222 having a first length L1, a first diameter D1, a first inlet end 224, and a first outlet end 226 opposite the first inlet end 224. The first substrate 222 defines a plurality of longitudinally extending, first flow passages 228. The number, configuration, and arrangement of the plurality of first flow passages 228 may vary in different embodiments. In the illustrated embodiment, the plurality of first flow passages 228 are configured as flow through passages (i.e., exhaust gas entering a passage at the first inlet end 224 will exit the same passage at the first outlet end 226).

A second catalyst substrate 230 is positioned within the second leg 214, separate from and parallel to, the first catalyst substrate 220. In the illustrated embodiment, the second catalyst substrate 230 is configured similar to the first catalyst substrate 220 and the description of the first catalyst substrate 220 applies equally to the second catalyst substrate 230. Thus, the second catalyst substrate 230 includes a cylindrical second substrate 232 having a second length L2, a second diameter D2, a second inlet end 234, and a second outlet end 236 opposite the second inlet end 234. The second substrate 232 defines a plurality of longitudinally extending, second flow passages 238. The number, configuration, and arrangement of the plurality of second flow passages 238 may vary in different embodiments. In the illustrated embodiment, the plurality of second flow passages 238 are configured as flow through passages (i.e., exhaust gas entering a passage at the second inlet end 234 will exit the same passage at the second outlet end 236).

The emissions module 102 may also include one or more restrictor plates 240 configured to block one or more of the plurality of first flow passages 228 and/or one or more of the second flow passages 238. The one or more restrictor plates 240 may be configured in a variety of ways, including different shapes, sizes, positions in the emissions module, and materials. Any structure and material capable of blocking exhaust flow through one or more flow passages to affect exhaust back pressure and the amount of catalyst exposed to the exhaust stream, and capable of functioning while exposed to exhaust conditions, may be used.

Figure 3:
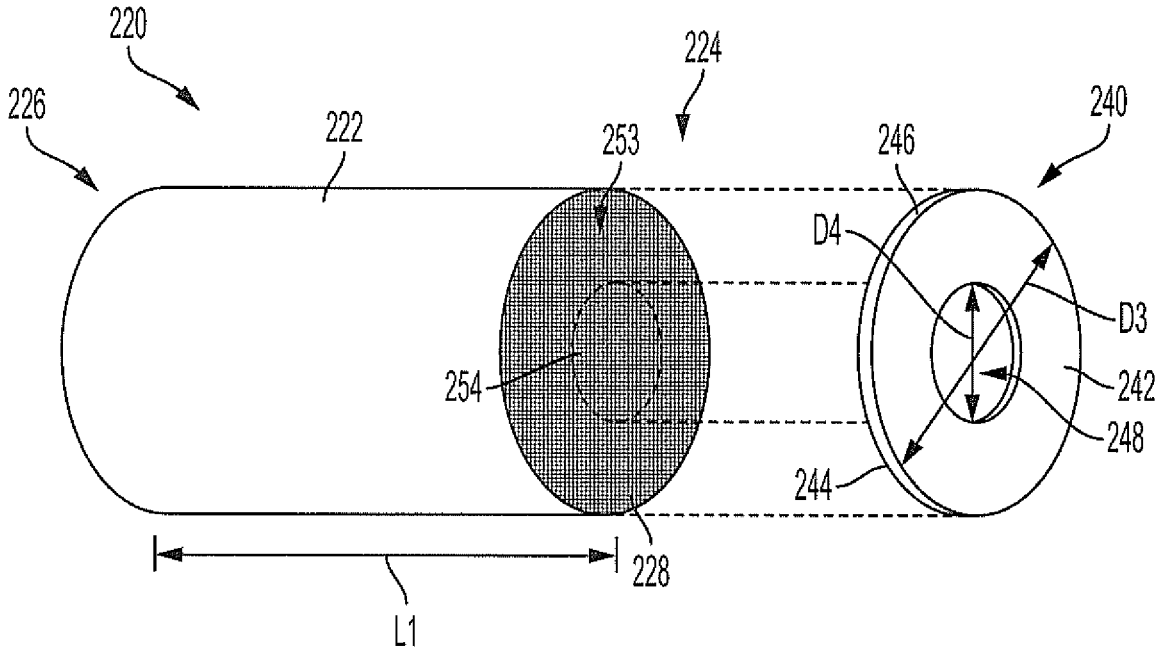
FIG. 3 is a perspective view of a substrate and restrictor plate for the emissions module of FIG. 2.

Referring to FIG. 3, in the illustrated embodiment, the emissions module 102 includes a first restrictor plate 240 having an annular body and positioned at the first inlet end 224 of the first catalyst substrate 220. The annular body having a planar outer face 242, a planar inner face 244 parallel to and opposite the outer face 242, and an outer circumferential edge 246 extending between the outer face 242 and the inner face 244. The first restrictor plate 240 has a first thickness T1, an outer third diameter D3, and an inner fourth diameter D4, which defines a first hole 248.

The first restrictor plate 240 may be made from a variety of materials suitable for use in high temperature embodiments. Preferably, the material(s) used in the first restrictor plate 240 are both corrosive resistant and resistant to moisture (i.e., does not swell). In some embodiments, the first restrictor plate 240 includes a ceramic, silica, or refractory fibrous material. Suitable material for use in the first restrictor plate 240 includes, but are not limited to, felt, ceramic insulation, woven stainless steel mesh, and a refractory cement/substrate cement/vanadia cement composition sandwich. In the illustrated embodiment, the first restrictor plate 240 has a ceramic felt layer 250 and a base layer 252. The base layer 252 is made of a weldable material that can readably be welded to the housing 200 of the emissions module 102, such as for example, steel or aluminium. In the illustrated embodiment, the base layer 252 is the same material as the housing 200.

The first restrictor plate 240 is positioned at the first inlet end 224 of the first catalyst substrate 220 in such a way that the first restrictor plate 240 blocks a first portion 253 of the first flow passages 228 (i.e., a blocked portion) to prevent exhaust flow through the first portion 253 and does not block a second portion 254 of the first flow passages 228 (i.e., an open portion) to allow exhaust to flow through the second portion 254. In the illustrated embodiment, the outer third diameter D3 is equal to the first diameter D1 of the first catalyst substrate 220.

In the illustrated embodiment, the felt layer 250 is placed in abutting engagement with the first inlet end 224 of the first catalyst substrate 220. The base layer 252 is then placed in engagement with the felt layer 250 such that the felt layer 250 is sandwiched between the first inlet end 224 of the first catalyst substrate 220 and the base layer 252. The base layer 252 may then be welded to the housing 200 to secure the first restrictor plate 240 in place. The felt layer 250 may be compressed between the base layer 252 and the first inlet end 224 of the first catalyst substrate 220 to provide a sealing function against the housing and first inlet end 224 of the first catalyst substrate 220.

The emissions module 102 may also include a diffuser plate 256 at or near the first inlet end 224 of the first catalyst substrate 220. The diffuser plate 256 is configured to make the exhaust flow uniform into the first catalyst substrate 220. The diffuser plate 256 may be configured in a variety of ways. In the illustrated embodiment, the diffuser plate 256 is a generally flat plate-like perforated body 258. The body 258 includes a plurality of evenly spaced apart holes 260 extending through the body 258.

Figure 4:
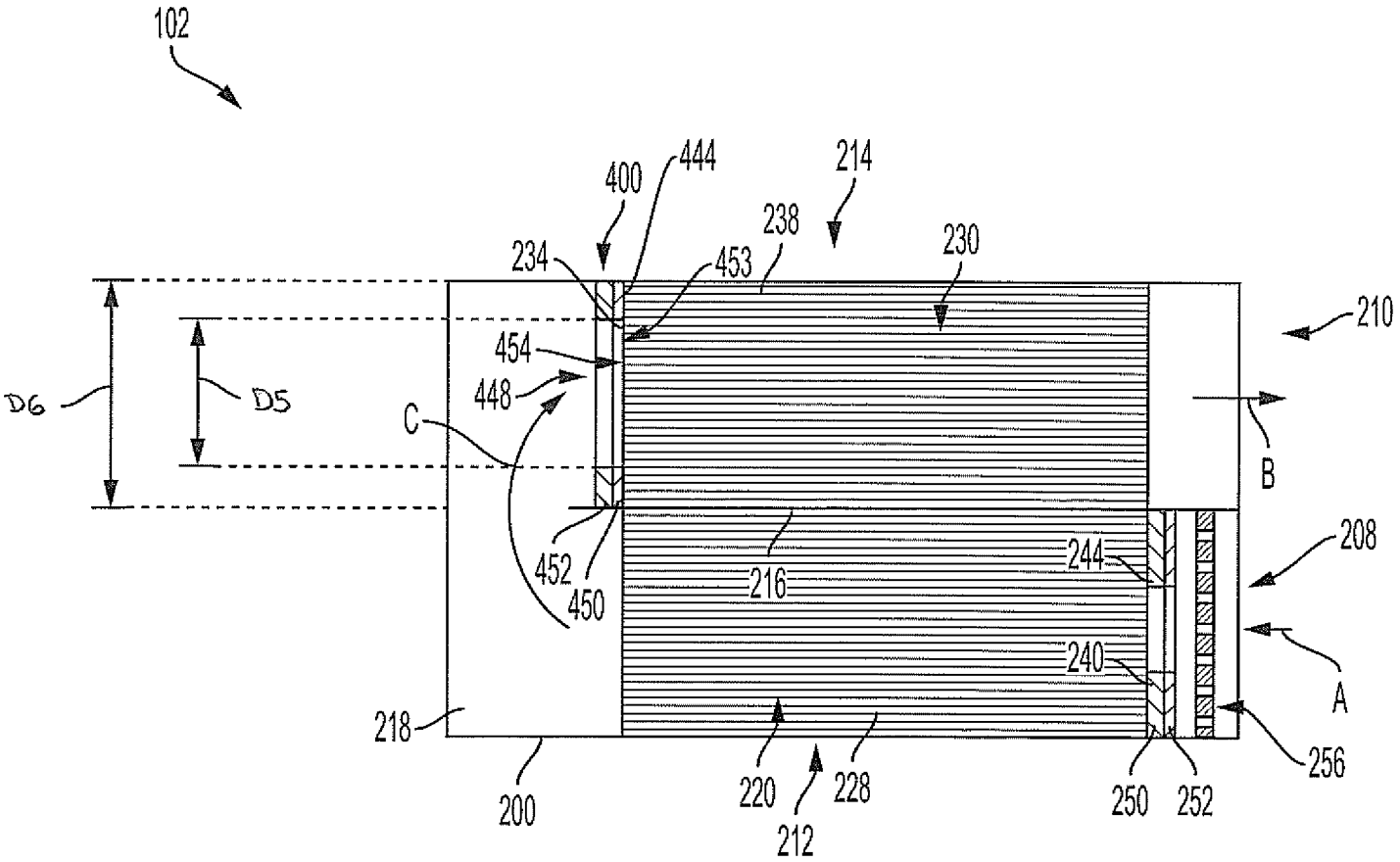
FIG. 4 is a schematic illustration of another exemplary embodiment of the emissions module of FIG. 1.
Figure 5:
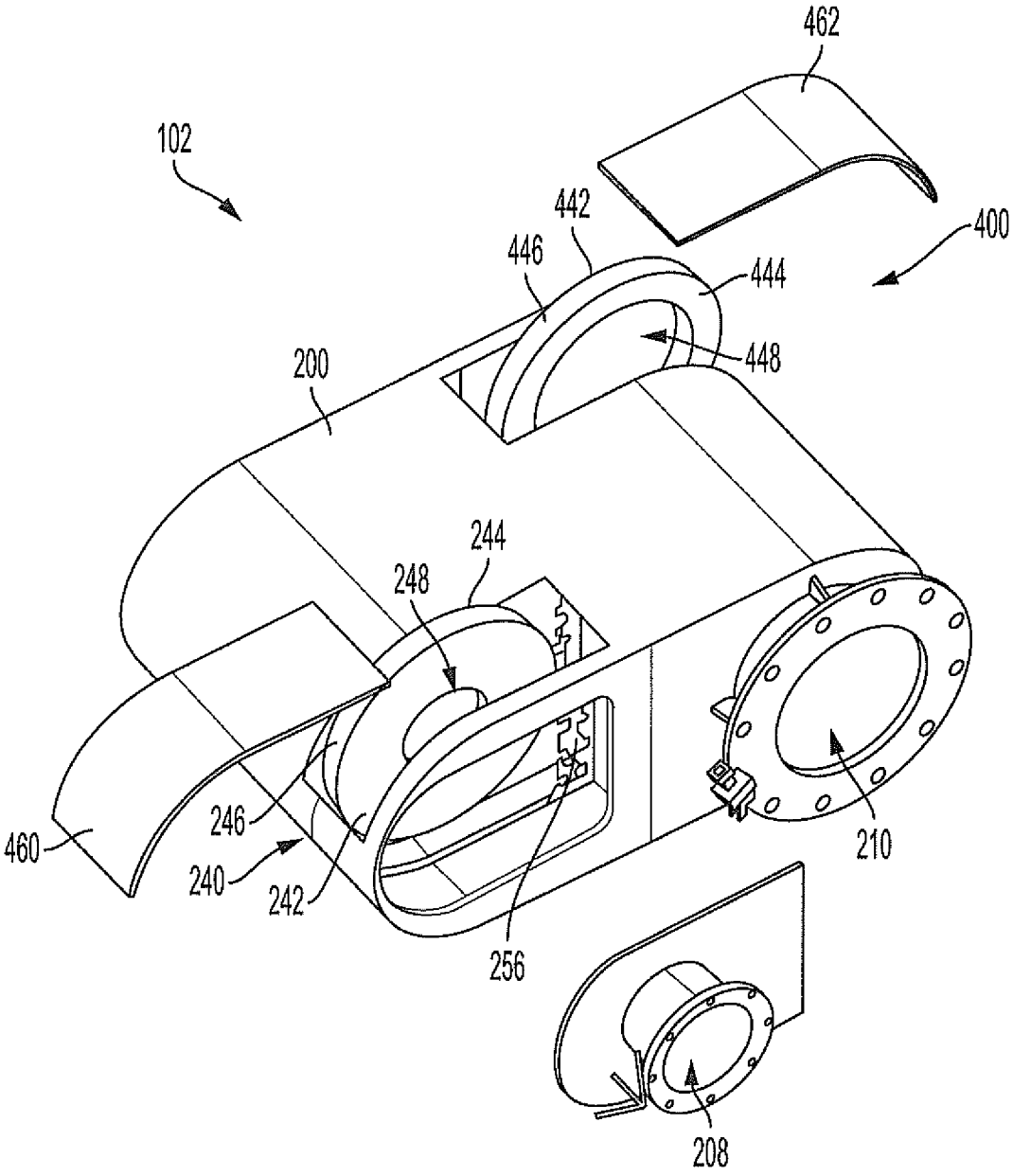
FIG. 5 is a perspective view of the emissions module of FIG. 4.

Referring to FIGS. 4-5, another embodiment of the emissions module 102 is illustrated. The emissions module 102 of FIGS. 4-5 is substantially similar to the emissions module 102 of FIGS. 1-3 with the addition of a second annular restrictor plate 400 at the second inlet end 234 of the second catalyst substrate 230. The description of the emissions module 102 of FIGS. 1-3 applies equally to the emissions module of FIGS. 4-5.

The second restrictor plate 400 may be substantially the same as the first restrictor plate 240. Thus, for example, the size, shape, configuration, and materials used may be the same as the first restrictor plate 240. In other embodiments, however, the second restrictor plate 400 may differ than the first restrictor plate 240 in one or more ways, such as the size, shape, configuration, and materials used.

In the illustrated embodiment, the second restrictor plate 400 has a planar second outer face 442, a planar second inner face 444 parallel to and opposite the planar second outer face 442, and a second outer circumferential edge 446 extending between the second outer face 442 and the second inner face 444. The second restrictor plate 400 has a second thickness T2, an outer sixth diameter D6, and an inner fifth diameter D5, which defines a second hole 448. In the illustrated embodiment, the outer third diameter D3 is equal to the outer sixth diameter D6, but the inner fourth diameter D4 is smaller than the inner fifth diameter D5. Thus, the second hole 448 is larger than the first hole 248 resulting in less pressure drop and more catalyst being exposed to the exhaust across the second catalyst substrate 230 than with the first catalyst substrate 220.

In the illustrated embodiment, the second restrictor plate 440 is made from that same materials as the first restrictor plate 240. Thus, the second restrictor plate 440 has a ceramic felt layer 450 and a weldable base layer 452. The second restrictor plate 440 is positioned at the second inlet end 234 of the second catalyst substrate 230 in such a way that the second restrictor plate 440 blocks a first portion 453 of the second flow passages 238 (i.e., a blocked portion) to prevent exhaust flow through the first portion 453 and does not block a second portion 454 of the second flow passages 238 (i.e., an open portion) to allow exhaust to flow through the second portion 454. In the illustrated embodiment, the blocked first portion 453 of the second flow passages 238 is smaller in area than the blocked first portion 253 of the first flow passages 228. In other embodiments, however, the blocked first portion 453 of the second flow passages 238 may be larger in area than, or the same area as, the blocked first portion 253 of the first flow passages 228. Likewise, in the illustrated embodiment, the open second portion 454 of the second flow passages 238 is larger in area than the open second portion 254 of the first flow passages 228. In other embodiments, however, the open second portion 454 of the second flow passages 238 may be smaller in area than, or the same area as, the open second portion 254 of the first flow passages 228.

In the illustrated embodiment, the felt layer 450 is placed in abutting engagement with the second inlet end 234 of the second catalyst substrate 230. The base layer 452 is then placed in engagement with the felt layer 450 such that the felt layer 450 is sandwiched between the second inlet end 234 of the second catalyst substrate 230 and the base layer 452. The base layer 452 may than be welded to the housing 200 to secure the second restrictor plate 400 in place. The felt layer 250 may be compressed between the base layer 452 and the second inlet end 234 of the second catalyst substrate 230 to provide a sealing function against the housing 200 and against the second inlet end 234 of the second catalyst substrate 230.

As shown in FIG. 5, the housing 200 may include a first removable panel 460 providing access to the area adjacent the first inlet end 224 of the first catalyst substrate 220 and a second removable panel 462 providing access to the area adjacent the second inlet end 234 of the second catalyst substrate 230. The panels 460, 462 allow the emissions module 102 to be easily set-up with the suitable sized first restrictor plate 240 and second restrictor plate 400 given a specific engine and application.

Figure 6:
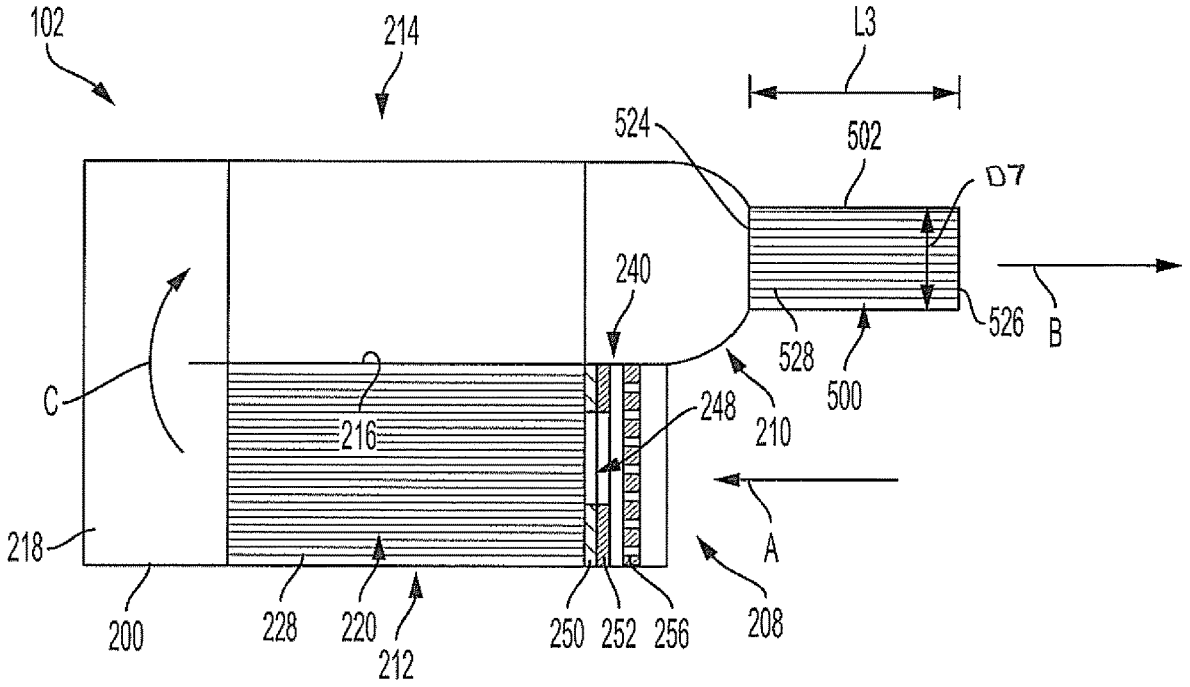
FIG. 6. is a schematic illustration of another exemplary embodiment of the emissions module of FIG. 1.

Referring to FIG. 6, another embodiment of the emissions module 102 is illustrated. The emissions module 102 of FIG. 6 is substantially similar to the emissions module 102 of FIGS. 1-3 except the second catalyst substrate 230 of the embodiment of FIGS. 1-3 is removed and a blank substrate 500 (i.e. substrate not treated with a catalyst) is included in a conduit 502 at the exhaust outlet 210 of the emissions module 102. The description of the emissions module 102 of FIGS. 1-3 applies equally to the emissions module of FIGS. 4-5.

The blank substrate 500 may be substantially the same as the first catalyst substrate 220 except the absence of catalyst. Thus, for example, the size, shape, and configuration may be the same as the first catalyst substrate 220 to provide the same or similar flow restriction and exhaust back pressure as the first catalyst substrate 220. In other embodiments, however, the blank substrate 500 may differ from the first catalyst substrate 220 in one or more ways, such as the size, shape, and configuration.

In the illustrated embodiment, the blank substrate 500 is positioned within the conduit 502, which defines, or downstream from, the exhaust outlet 210 if the emissions module 102. In other embodiments, however, the blank substrate 500 may be positioned in another location associated with the emissions module 102. For example, the blank substrate 500 may be positioned in the second leg 214 parallel to the first catalyst substrate 220.

The blank substrate 500 may be configured in a variety of ways, including, but not limited to, different shapes, sizes, and materials used. In the illustrated embodiment, the blank substrate 500 includes a cylindrical body having a length L3, a seventh diameter D7, an inlet end 524, and an outlet end 526 opposite the inlet end 524. The blank substrate 500 defines a plurality of longitudinally extending, flow passages 528. The number, configuration, and arrangement of the plurality of flow passages 528 may vary in different embodiments. In the illustrated embodiment, the plurality of flow passages 528 are configured as flow through passages (i.e., exhaust gas entering a passage at the inlet end 524 will exit the same passage at the outlet end 526).

INDUSTRIAL APPLICABILITY

The novel emissions module 102 may be used in a variety of applications. For example, the emissions module 102 may be part of an engine system 100 used to provide power to various types of applications and/or to machines, such as for example, an off-highway truck, a railway locomotive, a marine vessel, or an earth-moving machine. The term "machine" can also refer to stationary equipment like a generator that is driven by an internal combustion engine to generate electricity (i.e., gen-sets) or a pumping station having one or more pumps driven by an internal combustion engine.

Over the operating life of an engine system 100, changes may occur to the hardware or the operating software of the system that may change the rating of the engine (e.g., different turbocharger). In addition, changes may occur to the operational requirement of a specific application (e.g., changes to emission regulations). As a result of these changes, the current emissions module may no longer be suitable, or an emissions module may need to be added to an engine system that currently does not have one. Production emissions modules, however, may not provide the correct back pressure and the correct amount of catalyst for engine system The emissions module 102 of the present disclosure allows for the back pressure created by the emissions module and working catalyst volume (i.e., the amount of catalyst being exposed to the exhaust stream) of the emissions module to be adjusted by providing one or more restrictor plates 240, 400 and/or blank substrates 500. The restrictor plates both block flow through some passages of the emissions device (e.g. DOC brick) to limit the amount of catalyst being exposed to the exhaust stream and provide a flow restriction to create additional backpressure. The blank substrates serve to provide increased back pressure without adding any additional catalyst.

Unless otherwise indicated herein, all sub-embodiments and optional embodiments are respective sub-embodiments and optional embodiments to all embodiments described herein. While the present disclosure has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the present disclosure, in its broader aspects, is not limited to the specific details, the representative compositions or formulations, and illustrative examples shown and described. Accordingly, departures may be made from such details without departing from the spirit or scope of Applicant's general disclosure herein.

LIST OF ELEMENTS

| Element Number | Element Name |
|---|---|
| 100 | engine system |
| 102 | emissions module |
| 104 | internal combustion engine |
| 105 | cylinders |
| 106 | intake ports |
| 108 | exhaust ports |
| 110 | intake manifold |
| 112 | intake line |
| 114 | exhaust manifold |
| 116 | exhaust line |
| 200 | housing |
| 202 | first end |
| 204 | second end |
| 206 | exhaust flow path |
| 208 | exhaust inlet |
| 210 | exhaust outlet |
| 212 | first leg |
| 214 | second leg |
| 216 | divider wall |
| 218 | transition portion |
| 220 | first catalyst substrate |
| 222 | first substrate |
| 224 | first inlet end |
| 226 | first outlet end |
| 228 | first flow passages |
| 230 | second catalyst substrate |
| 232 | second substrate |
| 234 | second inlet end |
| 236 | second outlet end |
| 238 | second flow passages |
| 240 | first restrictor plate |
| 242 | planar outer face |
| 244 | planar inner face |
| 246 | outer circumferential edge |
| 248 | first hole |
| 250 | ceramic felt layer |
| 252 | base layer |
| 253 | first portion |
| 254 | second portion |
| 256 | diffuser plate |
| 258 | body |
| 260 | holes |
| 400 | second restrictor plate |
| 440 | second restrictor plate |
| 442 | planar second outer face |
| 444 | planar second inner face |
| 446 | second outer circumferential edge |
| 448 | second hole |
| 450 | felt layer |
| 452 | base layer |
| 453 | first portion |
| 454 | second portion |
| 460 | first removable panel |
| 462 | second removable panel |
| 500 | blank substrate |
| 502 | conduit |
| 524 | inlet end |
| 526 | outlet end |
| 528 | flow passages |

What is claimed is:

1. An emission module for treating exhaust gas, the emissions module comprising:

a housing;

a first catalyst substrate positioned within the housing and having an inlet end, the first catalyst substrate defining a plurality of flow passages extending longitudinally from the inlet end, the first catalyst substrate having a singular catalytic composition throughout; and a first restrictor plate positioned at the inlet end of the first catalyst substrate to block exhaust flow through a first portion of the plurality of flow passages while allowing exhaust flow through a remaining portion of the plurality of flow passages.

2. The emissions module of claim 1, wherein the first catalyst substrate is a diesel oxidation catalyst (DOC) brick.

3. The emissions module of claim 1, wherein the first restrictor plate includes one or more of a felt material, a ceramic insulation, a woven stainless steel mesh, or a refractory cement/substrate cement/vanadia cement composition.

4. The emissions module of claim 1, wherein the first restrictor plate comprises a first annular body defining a first hole therethrough, and wherein the first annular body blocks exhaust flow through the first portion of the plurality of flow passages and the first hole allows exhaust flow through the remaining portion of the plurality of flow passages.

5. The emissions module of claim 1, further comprising:

a second catalyst substrate positioned within the housing and having a second inlet end, the second catalyst substrate defining a plurality of second flow passages extending longitudinally from the second inlet end; and a second restrictor plate positioned at the second inlet end of the second catalyst substrate to block exhaust flow through a first portion of the plurality of second flow passages while allowing exhaust flow through a remaining portion of the plurality of second flow passages.

6. The emissions module of claim 5, wherein the second restrictor plate comprises a second annular body defining a second hole therethrough, and wherein the second annular body blocks exhaust flow through the first portion of the plurality of second flow passages and the second hole allows exhaust flow through the remaining portion of the plurality of second flow passages.

7. The emissions module of claim 6, wherein the first restrictor plate comprises a first annular body defining a first hole therethrough, and wherein the first hole has a first diameter and the second hole has a second diameter that is different from the first diameter.

8. The emissions module of claim 5, wherein the second restrictor plate includes one or more of a felt material, a ceramic insulation, a woven stainless steel mesh, or a refractory cement/substrate cement/vanadia cement composition.

9. The emissions module of claim 5, wherein the second catalyst substrate is parallel to the first catalyst substrate and the emissions module is configured such that exhaust gas flows through the first catalyst substrate and the second catalyst substrate in series.

10. The emissions module of claim 1, further comprising a blank substrate positioned within the housing and having a second inlet end, the blank substrate defining a plurality of second flow passages extending longitudinally from the second inlet end, wherein the blank substrate is parallel to the first catalyst substrate and the emissions module is configured such that exhaust gas flows through the first catalyst substrate and the blank substrate in series.

11. An engine system, comprising:

an internal combustion engine, comprising:

one or more engine cylinders; and an exhaust manifold for routing exhaust gas from the one or more engine cylinders;

an exhaust line configured to receive exhaust gas from the exhaust manifold; and an emission module positioned in the exhaust line for treating exhaust gas, the emissions module comprising:

a housing;

a first catalyst substrate positioned within the housing and having an inlet end, the first catalyst substrate defining a plurality of flow passages extending longitudinally from the inlet end; and a first restrictor plate positioned at the inlet end of the first catalyst substrate to block exhaust flow through a first portion of the plurality of flow passages while allowing exhaust flow through a remaining portion of the plurality of flow passages, the first restrictor plate being in abutting engagement with the inlet end of the first catalyst substrate to form a seal between the first restrictor plate and the first catalyst substrate.

12. The engine system of claim 11, wherein the first restrictor plate includes one or more of a felt material, a ceramic insulation, a woven stainless steel mesh, or a refractory cement/substrate cement/vanadia cement composition.

13. The engine system of claim 11, wherein the first restrictor plate comprises a first annular body defining a first hole therethrough, and wherein the first annular body blocks exhaust flow through the first portion of the plurality of flow passages and the first hole allows exhaust flow through the remaining portion of the plurality of flow passages.

14. The engine system of claim 11, further comprising;

a second catalyst substrate positioned within the housing and having a second inlet end, the second catalyst substrate defining a plurality of second flow passages extending longitudinally from the second inlet end; and a second restrictor plate positioned at the second inlet end of the second catalyst substrate to block exhaust flow through a first portion of the plurality of second flow passages while allowing exhaust flow through a remaining portion of the plurality of second flow passages.

15. The emissions module of claim 14, wherein the second restrictor plate comprises a second annular body defining a second hole therethrough, and wherein the second annular body blocks exhaust flow through the first portion of the plurality of second flow passages and the second hole allows exhaust flow through the remaining portion of the plurality of second flow passages.

16. The emissions module of claim 11, further comprising a blank substrate positioned within the housing and having a second inlet end, the blank substrate defining a plurality of second flow passages extending longitudinally from the second inlet end, wherein the blank substrate is parallel to the first catalyst substrate and the emissions module is configured such that exhaust gas flows through the first catalyst substrate and the blank substrate in series.

17. An emission module for treating exhaust gas, the emissions module comprising:

a housing;

a first catalyst substrate positioned within the housing and having an inlet end, the first catalyst substrate defining a plurality of flow passages extending longitudinally from the inlet end;

a first restrictor plate positioned at the inlet end of the first catalyst substrate to block exhaust flow through a first portion of the plurality of flow passages while allowing exhaust flow through a remaining portion of the plurality of flow passages;

a second catalyst substrate positioned within the housing and having a second inlet end, the second catalyst substrate defining a plurality of second flow passages extending longitudinally from the second inlet end; and a second restrictor plate positioned at the second inlet end of the second catalyst substrate to block exhaust flow through a first portion of the plurality of second flow passages while allowing exhaust flow through a remaining portion of the plurality of second flow passages, wherein the second restrictor plate comprises a second annular body defining a second hole therethrough, and wherein the second annular body blocks exhaust flow through the first portion of the plurality of second flow passages and the second hole allows exhaust flow through the remaining portion of the plurality of second flow passages.

18. The emissions module of claim 17, wherein the first restrictor plate comprises a first annular body defining a first hole therethrough, and wherein the first hole has a first diameter and the second hole has a second diameter that is greater than the first diameter.

19. The emissions module of claim 17, wherein the second catalyst substrate is parallel to the first catalyst substrate and the emissions module is configured such that exhaust gas flows through the first catalyst substrate and the second catalyst substrate in series.

20. The emissions module of claim 1, wherein the first restrictor plate is in abutting engagement with the inlet end of the first catalyst substrate to form a seal between the first restrictor plate and the first catalyst substrate.

* * * * *